US010004998B2

(12) United States Patent
Shih et al.

(10) Patent No.: US 10,004,998 B2
(45) Date of Patent: Jun. 26, 2018

(54) BUILDING BLOCK

(71) Applicant: National Taiwan University of Science and Technology, Taipei (TW)

(72) Inventors: Shen-Guan Shih, Taipei (TW); Jyun-Li Chen, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 297 days.

(21) Appl. No.: 14/919,748

(22) Filed: Oct. 22, 2015

(65) Prior Publication Data

US 2016/0121234 A1 May 5, 2016

(30) Foreign Application Priority Data

Oct. 31, 2014 (TW) ..... 103137744 A

(51) Int. Cl.
*A63H 33/04* (2006.01)
*A63H 33/08* (2006.01)

(52) U.S. Cl.
CPC ..... *A63H 33/08* (2013.01); *A63H 33/04* (2013.01)

(58) Field of Classification Search
USPC ..... 446/85, 108, 117, 124, 125; 434/195, 434/208; 273/156, 157 R, 160
See application file for complete search history.

(56) References Cited

U.S. PATENT DOCUMENTS 3,065,970 A * 11/1962 Besley ..... A63F 9/12 273/160
D206,336 S * 11/1966 Wilson ..... 273/160
3,546,792 A * 12/1970 Sherman ..... A63H 33/088 273/160
3,672,681 A * 6/1972 Wolf ..... A63F 9/12 273/157 R
4,153,254 A * 5/1979 Marc ..... A63F 9/12 273/160
4,274,221 A 6/1981 Boutet
(Continued)

FOREIGN PATENT DOCUMENTS

CN 202961894 U 6/2013
JP S46-17612 5/1971
(Continued)

*Primary Examiner* — Kurt Fernstrom
(74) *Attorney, Agent, or Firm* — CKC & Partners Co., Ltd.

(57) ABSTRACT

A building block includes a connecting part, a head part, and a tail part. The head part and the tail part are respectively connected to the connecting part. The head part is assembled with a head part or a tail part of another building block to form a head assembled structure or a head-tail assembled structure. The tail part is assembled with a head part or a tail part of another building block to form the head-tail assembled structure or a tail assembled structure. The building block forms a cyclic semi-structure or a columnar semi-structure with other building blocks by the three assembling methods. The cyclic semi-structure and the columnar semi-structure are assembled with another corresponding cyclic semi-structure or columnar semi-structure to form an annular column or a column by assembling the head assembled structures, the head-tail assembled structures, and the tail assembled structures.

9 Claims, 7 Drawing Sheets

(56) References Cited

U.S. PATENT DOCUMENTS

| | | | | | |
|---|---|---|---|---|---|
| 4,534,563 | A * | 8/1985 | Guenther | A63F 9/12 | 273/157 R |
| 4,662,638 | A * | 5/1987 | Vachek | A63F 9/12 | 273/160 |
| 4,699,602 | A * | 10/1987 | Giorgi | A63F 9/12 | 273/157 R |
| 5,393,063 | A * | 2/1995 | Ichimaru | A63F 9/12 | 273/160 |
| 5,823,533 | A * | 10/1998 | Edwards | A63F 9/12 | 273/160 |
| 5,868,388 | A * | 2/1999 | Wood | A63F 3/0023 | 273/157 R |
| 6,241,248 | B1 | 6/2001 | Winter | | |
| 6,648,330 | B2 * | 11/2003 | Porter | A63F 9/12 | 273/153 R |
| 6,790,118 | B2 * | 9/2004 | Ahn | A63H 33/04 | 434/208 |
| 6,910,691 | B2 * | 6/2005 | Shih | A63F 9/1204 | 273/157 R |
| 7,140,612 | B2 * | 11/2006 | Chen | A63F 9/12 | 273/156 |
| 8,387,989 | B2 * | 3/2013 | Baum | A63F 9/0073 | 273/156 |
| 2002/0121739 | A1 * | 9/2002 | Sum | A63F 9/12 | 273/156 |
| 2005/0110212 | A1 | 5/2005 | Shih | | |

FOREIGN PATENT DOCUMENTS

| | | | |
|---|---|---|---|
| JP | 2006230968 | A | 9/2006 |
| TW | 408625 | U | 10/2000 |
| TW | 433085 | U | 5/2001 |
| WO | 03/059478 | A1 | 7/2003 |

* cited by examiner

BUILDING BLOCK

RELATED APPLICATIONS

This application claims priority to Taiwan Application Serial Number 103137744, filed Oct. 31, 2014, which are herein incorporated by reference.

BACKGROUND

Technical Field

The present disclosure relates to a building block.

Description of Related Art

Assembling units of conventional building blocks often have different shapes or length variations of the assembling edges and are assembled in a specific space. Different forms of building blocks or puzzles can be created by using different shapes and length variations of the assembling edges, which inspires the user's creativity and spatial cognitive ability.

However, often general building blocks can only be assembled into a specific pattern, and the shapes of the assembling units of the building blocks are different, such that the manufacturing cost of the building blocks is high and the user will not be able to create different patterns by assembling the building blocks.

SUMMARY

This disclosure provides a building block. By assembling a plurality of the building blocks, a column or an annular column with different shapes can be formed.

In one aspect of the disclosure, a building block is provided. The building block includes a connecting part, a head part, and a tail part. The head part and the tail part are respectively connected to the connecting part. The head part is configured to be assembled with a head part of another building block to form a head assembled structure or assembled with a tail part of another building block to form a head-tail assembled structure. The tail part is configured to be assembled with a head part of another building block to form the head-tail assembled structure or assembled with a tail part of another building block to form a tail assembled structure. The building block is configured to form a cyclic semi-structure or a columnar semi-structure with other building blocks by the three assembling methods. The cyclic semi-structure and the columnar semi-structure are configured to form an annular column or a column by assembling the head assembled structure, the head-tail assembled structure, and the tail assembled structure respectively with a tail assembled structure, a head-tail assembled structure, and a head assembled structure of another corresponding cyclic semi-structure or columnar semi-structure.

In one or more embodiments, the head part is a hook-shaped structure toward an upward direction.

In one or more embodiments, the tail part is a hook-shaped structure toward an upward direction.

In one or more embodiments, the connecting part has a left part and a right part, the head part is connected to a top surface of the left part, and the tail part is connected to a rear surface of the right part.

In one or more embodiments, the head part is a hook-shaped structure toward an upward direction, and three cubes with the same size form the head part.

In one or more embodiments, the tail part is a hook-shaped structure toward an upward direction, and three cubes with the same size form the tail part.

In one or more embodiments, the cubes with the same size form the head part and the tail part.

In one or more embodiments, the left part and the right part are respectively cubes with the same size.

In one or more embodiments, the head part is a hook-shaped structure toward an upward direction, and the head part is formed by three cubes, in which the size of the three cubes are the same as the size of the left part.

In one or more embodiments, the tail part is a hook-shaped structure toward an upward direction, and the tail part is formed by three cubes, in which the size of the three cubes are the same as the size of the right part.

By the three basic assembling methods, i.e., assembling the head parts to form the head assembled structure, assembling the head part and the tail part to form the head-tail assembled structure, and assembling the tail parts to form the tail assembled structure, the building blocks can form the columnar semi-structure or the cyclic semi-structure. Then, the columnar semi-structure or the cyclic semi-structure can form the column or the annular column by assembling the head assembled structure of the columnar semi-structure and the tail assembled structure of the corresponding columnar semi-structure, the head-tail assembled structure of the columnar semi-structure and the head-tail assembled structure of the corresponding columnar semi-structure, and the tail assembled structure of the columnar semi-structure and the head assembled structure of the corresponding columnar semi-structure. Because the assembling units of the column and the annular column are the building blocks with the same shape, the manufacturing costs can be reduced. In addition, because the building blocks can form a column or an annular column with different shapes, the user can flexibly assemble the column or the annular column with the shape he want.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1A:
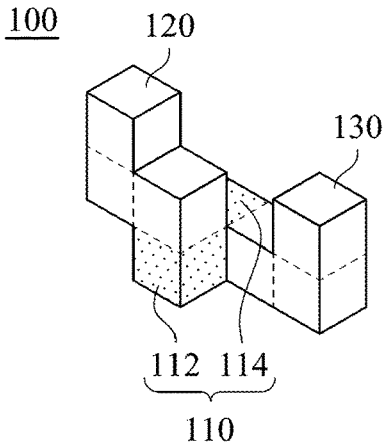
FIG. 1A is a schematic perspective view of a building block according to one embodiment of this invention.

FIG. 1A is a schematic perspective view of a building block 100 according to one embodiment of this invention. As shown in FIG. 1A, a building block 100 is provided. The building block 100 can be assembled to form a column 700 of FIG. 6D and an annular column 800 of FIG. 7D, in which the size and the shape of each of the building blocks 100 forming the column 700 and the annular column 800 are the same.

Figure 1D:
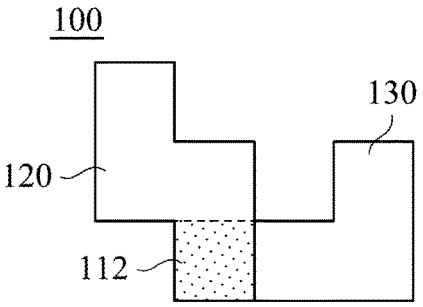
FIG. 1D is a schematic left view of the building block of FIG. 1A.
Figure 1B:
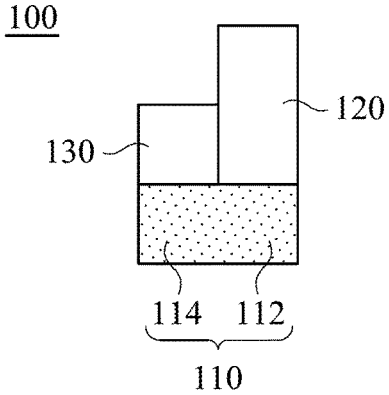
FIG. 1B is a schematic front view of the building block of FIG. 1A.
Figure 1E:
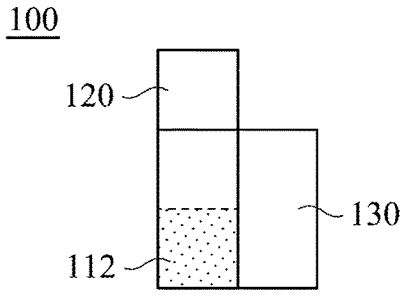
FIG. 1E is a schematic rear view of the building block of FIG. 1A.
Figure 1F:
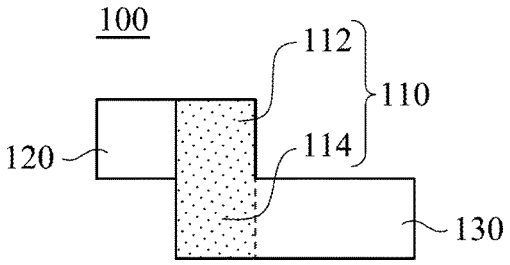
FIG. 1F is a schematic bottom view of the building block of FIG. 1A.
Figure 1C:
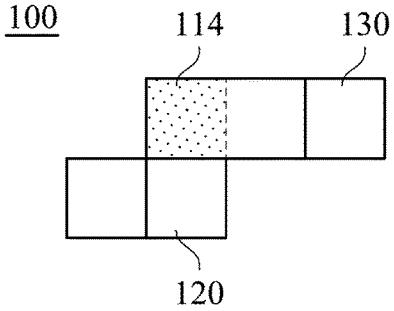
FIG. 1C is a schematic top view of the building block of FIG. 1A.
Figure 1G:
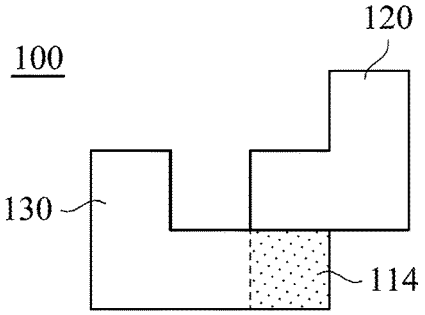
FIG. 1G is a schematic right view of the building block of FIG. 1A.

FIG. 1B is a schematic front view of the building block 100 of FIG. 1A. FIG. 1C is a schematic top view of the building block 100 of FIG. 1A. FIG. 1D is a schematic left view of the building block 100 of FIG. 1A. FIG. 1E is a schematic rear view of the building block 100 of FIG. 1A. FIG. 1F is a schematic bottom view of the building block 100 of FIG. 1A. FIG. 1G is a schematic right view of the building block 100 of FIG. 1A. As shown in FIG. 1A to FIG. 1G, the building block 100 includes a connecting part 110 (dot area), a head part 120, and a tail part 130. The head part 120 and the tail part 130 are respectively connected to the connecting part 110. The connecting part 110 has a left part 112 and a right part 114 (in order to clearly illustrate all characteristics of the building block, FIG. 1A is depicted from the rear ramp of the building block 110). The head part 120 is connected to a top surface of the left part 112, and the tail part 130 is connected to a rear surface of the right part 114. The head part 120 is a hook-shaped structure toward an upward direction. The tail part 130 is a hook-shaped structure toward an upward direction.

Specifically, the left part 112 and the right part 114 are respectively cubes with the same size. The head part 120 is formed by three cubes, in which the size of the three cubes are the same as the size of the left part 112 or the right part 114. The tail part 130 is formed by three cubes, in which the size of the three cubes are the same as the size of the left part 112 or the right part 114. In other words, three cubes with the same size form the head part 120. Three cubes with the same size form the tail part 130. The head part 120 and the tail part 130 are formed by the cubes with the same size There are three basic methods for assembling the building block 100 and other building blocks 100, and the details are described below.

Figure 2A:
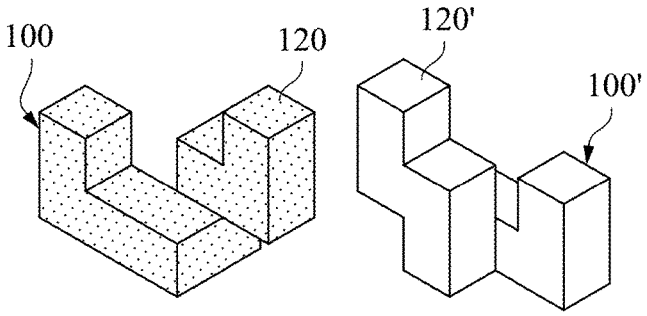
FIG. 2A is a schematic perspective view of two building blocks with two head parts thereof facing each other according to one embodiment of this invention.
Figure 2B:
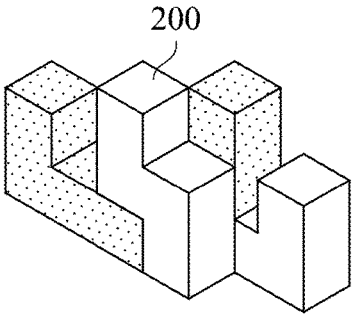
FIG. 2B is a schematic perspective view of a head assembled structure formed by the building blocks of FIG. 2A.

FIG. 2A is a schematic perspective view of two building blocks 100, 100' with two head parts 120, 120' thereof facing each other according to one embodiment of this invention. FIG. 2B is a schematic perspective view of a head assembled structure 200 formed by the building blocks 100, 100' of FIG. 2A. As shown in FIG. 2A and FIG. 2B, the head part 120 of the building block 100 and the head part 120' of the building block 100' face each other and then are assembled together to form a head assembled structure 200.

Figure 3A:
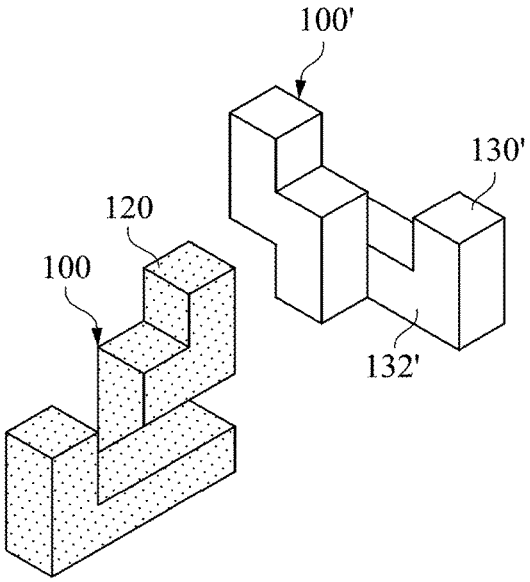
FIG. 3A is a schematic perspective view of the building block with the head part thereof facing a tail part of another building block according to one embodiment of this invention.
Figure 3B:
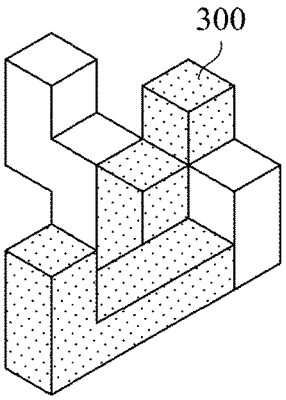
FIG. 3B is a schematic perspective view of a head-tail assembled structure formed by the building blocks of FIG. 3A.

FIG. 3A is a schematic perspective view of the building block 100 with the head part 120 thereof facing a tail part 130' of another building block 100' according to one embodiment of this invention. FIG. 3B is a schematic perspective view of a head-tail assembled structure 300 formed by the building blocks 100, 100' of FIG. 3A. As shown in FIG. 3A and FIG. 3B, the head part 120 of the building block 100 faces a left side surface of the tail part 130' of the building block 100', and then the building block 100, 100 are assembled together to form a head-tail assembled structure 300.

Figure 4A:
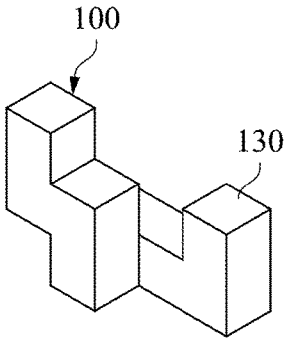
FIG. 4A is a schematic perspective view of two building blocks with two tail parts thereof facing each other according to one embodiment of this invention.
Figure 4B:
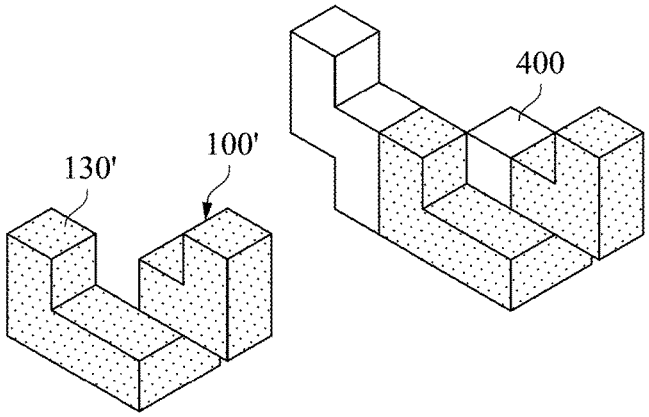
FIG. 4B is a schematic perspective view of a tail assembled structure formed by the building blocks of FIG. 4A.

FIG. 4A is a schematic perspective view of two building blocks 100, 100' with two tail parts 130, 130' thereof facing each other according to one embodiment of this invention. FIG. 4B is a schematic perspective view of a tail assembled structure 400 formed by the building blocks 100, 100' of FIG. 4A. As shown in FIG. 4A and FIG. 4B, the tail part 130 of the building block 100 and the tail part 130' of the building block 100' face each other and then are assembled together to form a tail assembled structure 400.

By the aforementioned assembling methods, the building blocks can form a strip structure by assembling with the head parts or the tail parts and a corner structure by assembling one head part and one tail part. Therefore, if one end of a building block is taken as the starting point, the structure formed by the building blocks can extend forwardly, to the left, or to the right, and finally the structure is connected to the other end of the initial building block, such that a cyclic structure is formed. The structure formed by the building blocks may not be cyclic. The structure formed by the building blocks starts from one end of a building block and then extends forwardly, to the left, or to the right, and finally the structure is connected to the other end of the initial building block. However, there may be no hollow in the center part of the structure, such that the structure may be strip-striped or columnar.

Figure 5A:
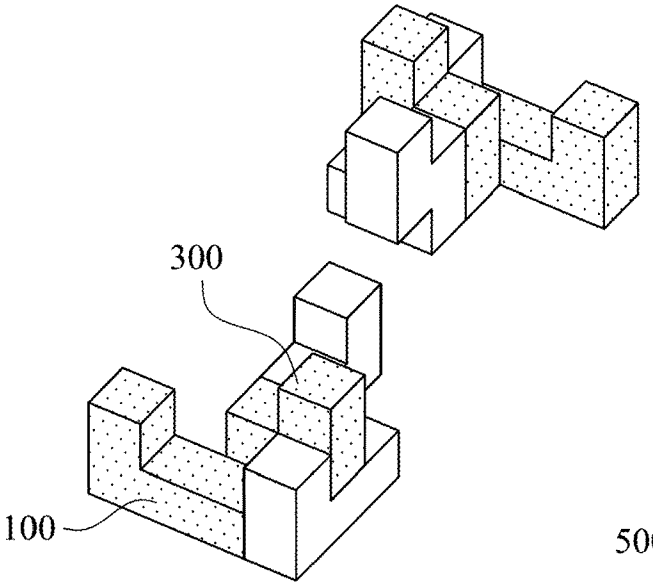
FIG. 5A is a schematic perspective view of a plurality of building blocks according to one embodiment of this invention.
Figure 5B:
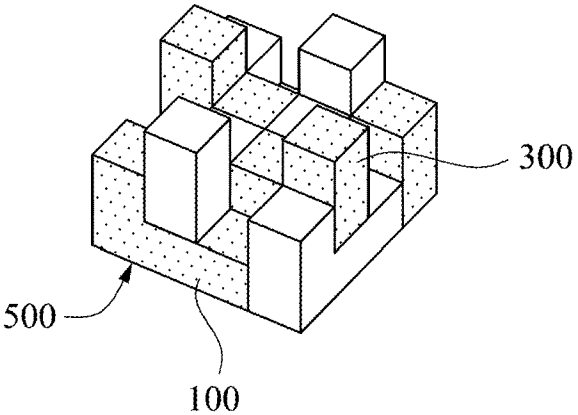
FIG. 5B is a schematic perspective view of a columnar semi-structure formed by the building blocks of FIG. 5A.
Figure 5C:
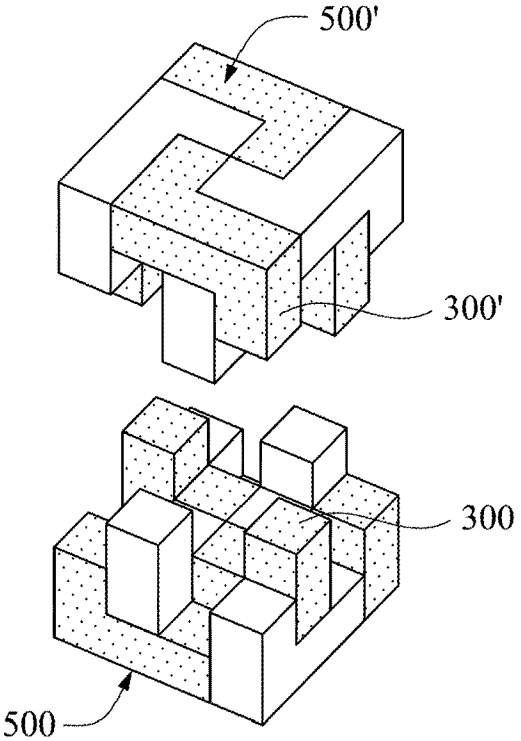
FIG. 5C is a schematic perspective view of the columnar semi-structure of FIG. 5B and another corresponding columnar semi-structure.

FIG. 5A is a schematic perspective view of a plurality of building blocks according to one embodiment of this invention. FIG. 5B is a schematic perspective view of a columnar semi-structure 500 formed by the building blocks of FIG. 5A. FIG. 5C is a schematic perspective view of the columnar semi-structure 500 of FIG. 5B and another corresponding columnar semi-structure 500'. As shown in FIG. 5A to FIG. 5C, a plurality of building blocks, such as the building block 100, are assembled to form a plurality of the head-tail assembled structures, such as the head-tail assembled structure 300, and then a columnar structure, i.e., a columnar semi-structure 500, is formed by the head-tail assembled structures. Then, the columnar semi-structure 500 can be assembled with another corresponding columnar semi-structure 500' to form a cube.

Specifically, as shown in FIG. 5A, every two building blocks are assembled to form one head-tail assembled structure. Then, as shown in FIG. 5B, the two head-tail assembled structure formed by the building blocks are assembled together to form the columnar semi-structure 500, in which the columnar semi-structure 500 are formed by four head-tail assembled structure. Then, as shown in FIG. 5C, the columnar semi-structure 500 is assembled with another corresponding columnar semi-structure 500', in which the shape of the head-tail assembled structure of the columnar semi-structure 500, such as the head-tail assembled structure 300, matches the shape of the head-tail assembled structure of the columnar semi-structure 500', such as the head-tail assembled structure 300', such that the columnar semi-structure 500 can be assembled with the columnar semi-structure 500' to form the cube.

Figures 6A, 6B, 6C, 6D:
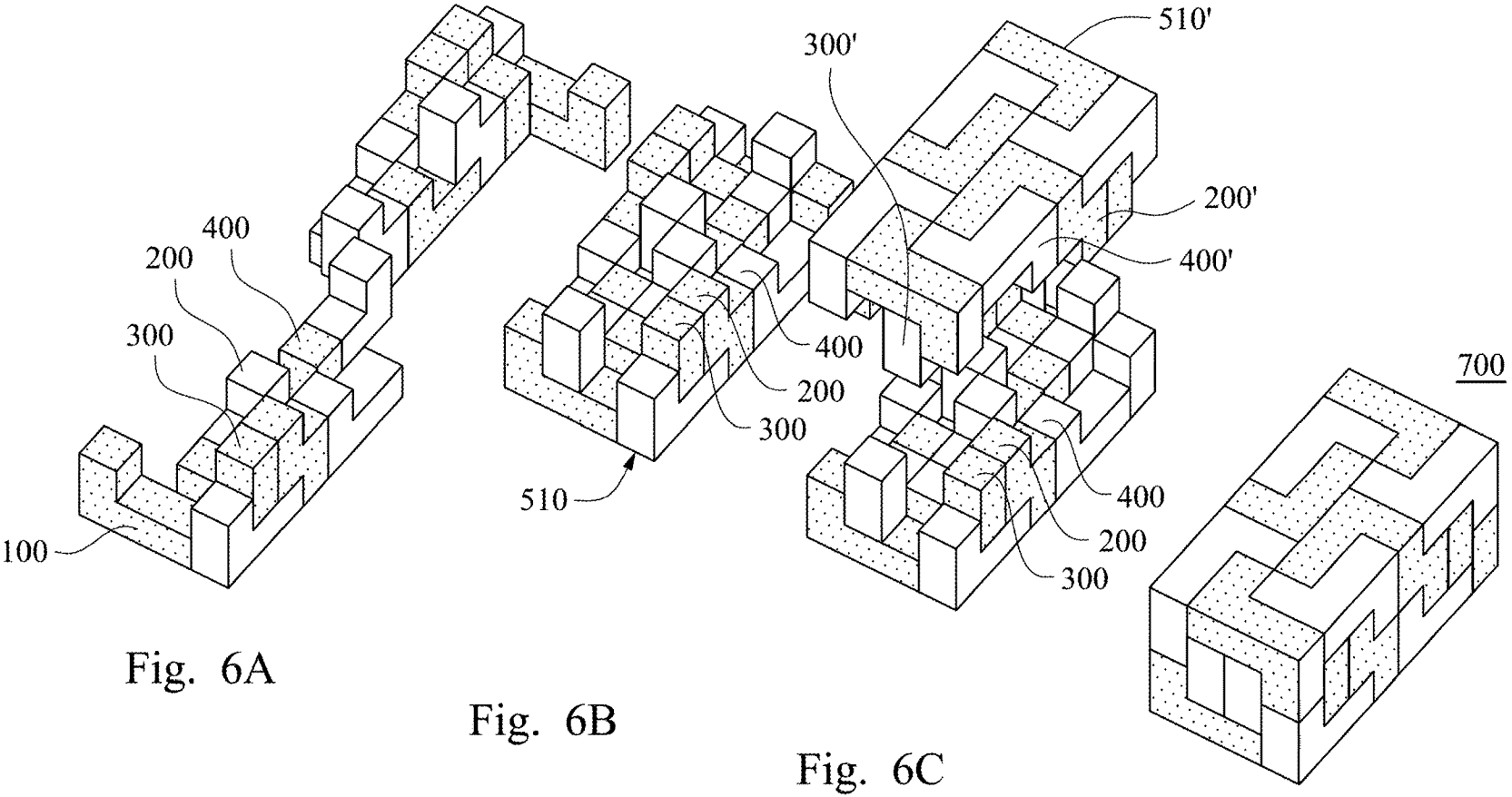
FIG. 6A is a schematic perspective view of a plurality of building blocks according to one embodiment of this invention.
FIG. 6B is a schematic perspective view of a columnar semi-structure formed by the building blocks of FIG. 6A.
FIG. 6C is a schematic perspective view of the columnar semi-structure of FIG. 6B and another corresponding columnar semi-structure.
FIG. 6D is a schematic perspective view of a column formed by the columnar semi-structures of FIG. 6C.

FIG. 6A is a schematic perspective view of a plurality of building blocks according to one embodiment of this invention. FIG. 6B is a schematic perspective view of a columnar semi-structure 510 formed by the building blocks of FIG. 6A. FIG. 6C is a schematic perspective view of the columnar semi-structure 510 of FIG. 6B and another corresponding columnar semi-structure 510'. FIG. 6D is a schematic perspective view of a column 700 formed by the columnar semi-structures 510, 510' of FIG. 6C. As shown in FIG. 6A to 6D, a plurality of building blocks, such as the building block 100, are assembled to form a plurality of the head assembled structures, the head-tail assembled structures, and the tail assembled structures, such as the head assembled structure 200, the head-tail assembled structure 300, and the tail assembled structure 400, and then the columnar semi-structure 510 is formed by assembling the head assembled structures, the head-tail assembled structures, and the tail assembled structures. Then, the columnar semi-structure 510 is assembled with another corresponding columnar semi-structure 510' to form a cube 700.

Specifically, as shown in FIG. 6A and FIG. 6B, eight building blocks are assembled to form the columnar semi-structure 510. Then, as shown in FIG. 6C, the columnar semi-structure 510 is assembled with another corresponding columnar semi-structure 510'. The shape of the head assembled structure of the columnar semi-structure 510, such as the head assembled structure 200, matches the shape of the tail assembled structure of the columnar semi-structure 510', such as the tail assembled structure 400'. The shape of the head-tail assembled structure of the columnar semi-structure 510, such as the head-tail assembled structure 300, matches the shape of the head-tail assembled structure of the columnar semi-structure 510', such as the head-tail assembled structure 300'. The shape of the tail assembled structure of the columnar semi-structure 510, such as the tail assembled structure 400, matches the shape of the head assembled structure of the columnar semi-structure 510', such as the head assembled structure 200'. Therefore, as shown in FIG. 6D, the columnar semi-structure 510 is assembled with the columnar semi-structure 510' to form the cube 700.

Figures 7A, 7B, 7C, 7D:
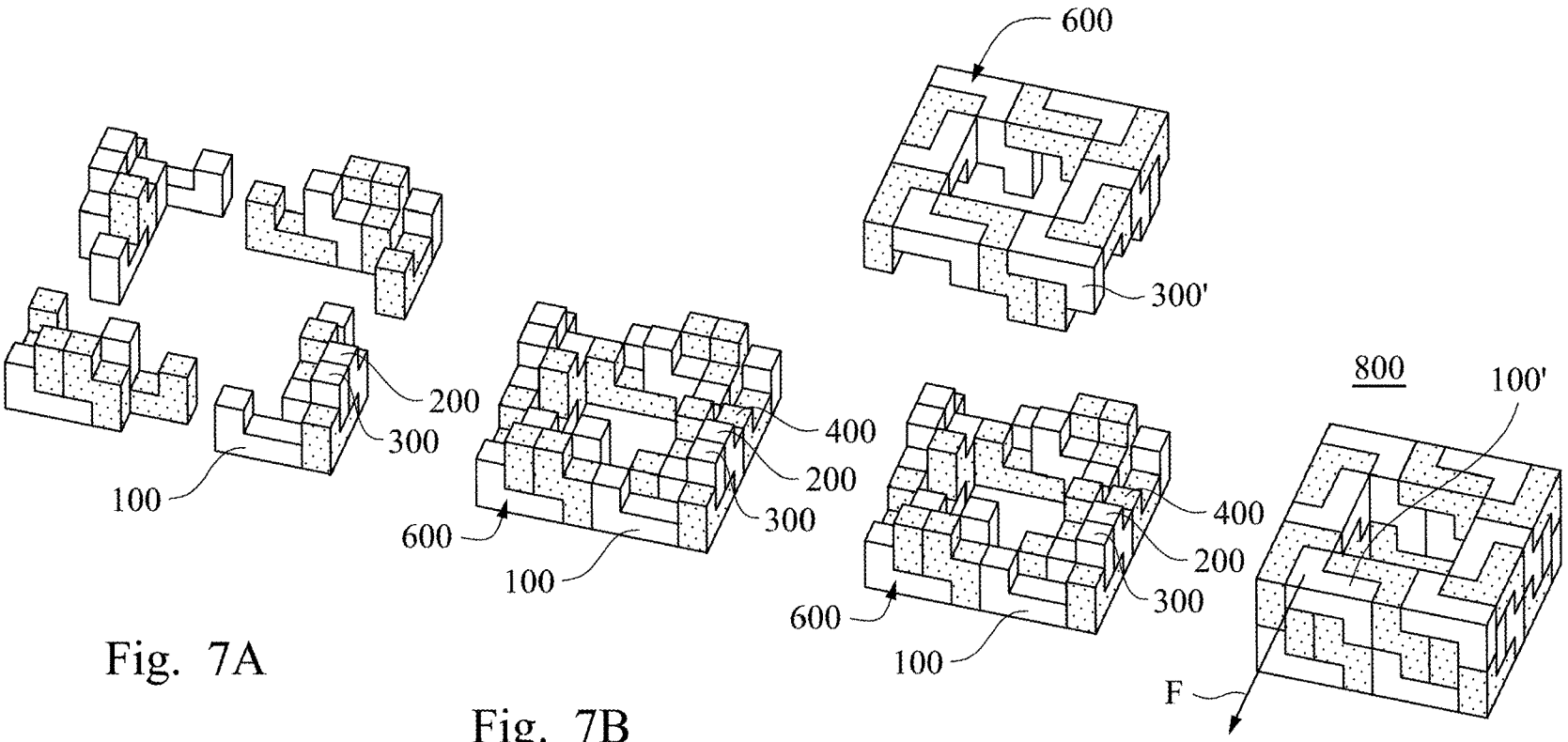
FIG. 7A is a schematic perspective view of a plurality of building blocks according to one embodiment of this invention.
FIG. 7B is a schematic perspective view of a cyclic semi-structure formed by the building blocks of FIG. 7A.
FIG. 7C is a schematic perspective view of the cyclic semi-structure of FIG. 7B and another corresponding cyclic semi-structure.
FIG. 7D is a schematic perspective view of an annular column formed by the cyclic semi-structures of FIG. 7C.

FIG. 7A is a schematic perspective view of a plurality of building blocks according to one embodiment of this invention. FIG. 7B is a schematic perspective view of a cyclic semi-structure 600 formed by the building blocks of FIG. 7A. FIG. 7C is a schematic perspective view of the cyclic semi-structure 600 of FIG. 7B and another corresponding cyclic semi-structure 600'. FIG. 7D is a schematic perspective view of an annular column 800 formed by the cyclic semi-structures 600, 600' of FIG. 7C. As shown in FIG. 7A to FIG. 7D, the embodiment is similar to the aforementioned embodiment, a plurality of building blocks are assembled together to form a plurality of the head assembled structures, the head-tail assembled structures, and the tail assembled structures, and then a cyclic semi-structure 600 is formed by assembling the head assembled structures, the head-tail assembled structures, and the tail assembled structures. Then, the cyclic semi-structure 600 is assembled with another corresponding cyclic semi-structure 600' to form an annular column 800.

Specifically, as shown in FIG. 7A and FIG. 7B, twelve building blocks are assembled to form a cyclic semi-structure 600. Then, as shown in FIG. 7C, the cyclic semi-structure 600 is assembled with another corresponding cyclic semi-structure 600'. The shape of the head assembled structure of the cyclic semi-structure 600 matches the shape of the tail assembled structure of the cyclic semi-structure 600'. The shape of the head-tail assembled structure of the cyclic semi-structure 600 matches the shape of the head-tail assembled structure of the cyclic semi-structure 600'. The shape of the tail assembled structure of the cyclic semi-structure 600 matches the shape of the head assembled structure of the cyclic semi-structure 600'. Therefore, as shown in FIG. 7D, the cyclic semi-structure 600 is assembled with the cyclic semi-structure 600' to form the annular column 800.

The building blocks can be assembled to form a column or an annular column with a shape different from the aforementioned shapes. The building blocks can form a columnar semi-structure and a cyclic semi-structure with different shapes by taking one end of a building block as the starting point, then extending the structure formed by the building blocks forwardly, to the left, or to the right, and finally connecting the structure to the other end of the initial building block. Thereafter, the columnar semi-structure is assembled with the corresponding columnar semi-structure, or the cyclic semi-structure is assembled with the corresponding cyclic semi-structure, such that a column or an annular column with different shapes can be formed.

In addition, because the building blocks of the column or the annular column are engaged with each other, the structure of the column or the annular column is pretty stable; the building blocks will not fall off easily to damage the structure of the column or the annular column. Specifically, as shown in FIG. 7D, if someone wants to remove the building block 100' from the annular column 800, the only way is applying a horizontal force in a direction toward the outer side of the annular column 800, and the building block 100' can be removed from the annular column 800. Applying forces in other directions cannot remove the building block 100' from the annular column 800.

Figure 8:
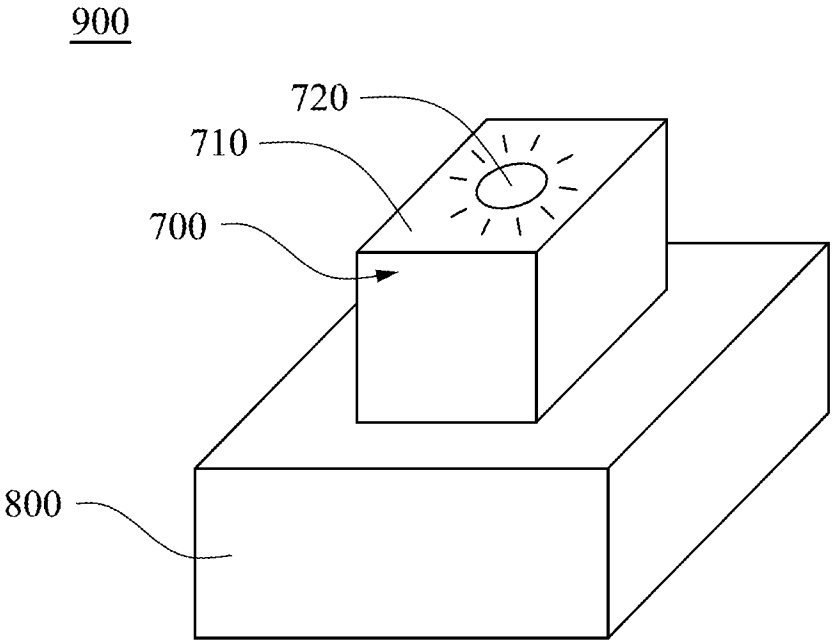
FIG. 8 is a schematic perspective view of a three-dimensional structure formed by the annular column and the column.

The column and the annular column formed by the building blocks can be assembled with each other to form a three-dimensional structure. FIG. 8 is a schematic perspective view of a three-dimensional structure 900 formed by the annular column 800 and the column 700. For example, as shown in FIG. 8, the column 700 of FIG. 6D can be put in and fixed to the annular column 800 of FIG. 7D to form a three-dimensional structure 900.

Furthermore, some special patterns can be disposed on the surface of the column or the annular column formed by the building blocks. Therefore, when someone is assembling the column or the annular column, he can also do a three-dimensional puzzle, and the assembled annular column or the column can be an ornament. For example, as shown in FIG. 8, a special pattern 720 is disposed on a top surface 710 of the column 700.

By the three basic assembling methods, i.e., assembling the head parts to form the head assembled structure, assembling the head part and the tail part to form the head-tail assembled structure, and assembling the tail parts to form the tail assembled structure, the building blocks can form the columnar semi-structure or the cyclic semi-structure. Then, the columnar semi-structure or the cyclic semi-structure can form the column or the annular column by assembling the head assembled structure of the columnar semi-structure and the tail assembled structure of the corresponding columnar semi-structure, the head-tail assembled structure of the columnar semi-structure and the head-tail assembled structure of the corresponding columnar semi-structure, and the tail assembled structure of the columnar semi-structure and the head assembled structure of the corresponding columnar semi-structure. Because the assembling units of the column and the annular column are the building blocks with the same shape, the manufacturing costs can be reduced. In addition, because the building blocks can form a column or an annular column with different shapes, the user can flexibly assemble the column or the annular column with the shape he want.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. § 112, 6th paragraph. In particular, the use of "step of" in the claims herein is not intended to invoke the provisions of 35 U.S.C. § 112, 6th paragraph.

What is claimed is:

1. A building block, comprising:

a connecting part; and a head part and a tail part respectively connected to the connecting part, wherein the head part is a hook-shaped structure toward an upward direction, the tail part is a hook-shaped structure toward an upward direction, the connecting part has a left part and a right part, the head part is connected to a top surface of the left part, and the tail part is connected to a rear surface of the right part, wherein the head part is configured to be assembled with a head part or a tail part of another building block having the same structure as the building block to form a cyclic semi-structure and an annular column.

2. The building block of claim 1, wherein three cubes with the same size form the head part.

3. The building block of claim 2, wherein three cubes with the same size form the tail part.

4. The building block of claim 1, wherein three cubes with the same size form the tail part.

5. The building block of claim 4, wherein three cubes with the same size form the head part.

6. The building block of claim 1, wherein the left part and the right part are respectively cubes with the same size.

7. The building block of claim 6, wherein the head part is a hook-shaped structure toward an upward direction, and the head part is formed by three cubes, wherein the size of the three cubes is the same as the size of the left part.

8. The building block of claim 6, wherein the tail part is a hook-shaped structure toward an upward direction, and the tail part is formed by three cubes, wherein the size of the three cubes is the same as the size of the right part.

9. A building block assembly, comprising:

a plurality of building blocks, wherein each building block has a connecting part and a head part and a tail part respectively connected to the connecting part; and wherein the head part of one of the building blocks is configured to be assembled with the head part of another of the building blocks to form a head assembled structure or assembled with the tail part of another of the building blocks to form a head-tail assembled structure, the tail part of one of the building blocks is configured to be assembled with the head part of another of the building blocks to form the head-tail assembled structure or assembled with the tail part of another of the building blocks to form a tail assembled structure, wherein the building blocks are configured to form a cyclic semi-structure by the head assembled structure, the head-tail assembled structure and the tail assembled structure, the cyclic semi-structure is configured to form an annular column by assembling the head assembled structure, the head-tail assembled structure, and the tail assembled structure respectively with the tail assembled, the head-tail assembled structure, and the head assembled structure of another corresponding cyclic semi-structure.

* * * * *